US010156072B2

(12) United States Patent
Vartanian

(10) Patent No.: US 10,156,072 B2
(45) Date of Patent: Dec. 18, 2018

(54) FLOOD PROTECTION DEVICE

(71) Applicant: Markar Vartanian, Northhampton (GB)

(72) Inventor: Markar Vartanian, Northhampton (GB)

( * ) Notice: Subject to any disclaimer, the term of this patent is extended or adjusted under 35 U.S.C. 154(b) by 0 days.

(21) Appl. No.: 15/574,826

(22) PCT Filed: May 19, 2016

(86) PCT No.: PCT/GB2016/051439

§ 371 (c)(1),
(2) Date: Nov. 16, 2017

(87) PCT Pub. No.: WO2016/189275

PCT Pub. Date: Dec. 1, 2016

(65) Prior Publication Data

US 2018/0155927 A1 Jun. 7, 2018

(30) Foreign Application Priority Data

May 26, 2015 (GB) ..... 1508916.2

(51) Int. Cl.

| | |
|---|---|
| ***E02B 7/20*** | (2006.01) |
| ***E04C 1/39*** | (2006.01) |
| ***E04B 1/70*** | (2006.01) |
| *F24F 7/00* | (2006.01) |

(52) U.S. Cl.
CPC ..... *E04C 1/392* (2013.01); *E04B 1/7076* (2013.01); *E04C 1/39* (2013.01); *F24F 2007/003* (2013.01); *F24F 2221/52* (2013.01)

(58) Field of Classification Search
CPC ..... F24F 7/00
See application file for complete search history.

(56) References Cited

U.S. PATENT DOCUMENTS 2,851,861 A * 9/1958 Ponsar ..... E02B 7/18 137/101.25
7,926,539 B1 4/2011 Hurst et al.

FOREIGN PATENT DOCUMENTS

| | | | |
|---|---|---|---|
| JP | 2011220048 | B1 | 11/2011 |
| WO | WO0208533 | A1 | 1/2002 |
| WO | WO2010060705 | A2 | 6/2010 |

OTHER PUBLICATIONS

European Patent Office, International Searching Authority, International Search Report, PCT/GB2016/051439, dated Jul. 28, 2016, pp. 1-4, European Patent Office, The Hague, Netherlands.
Intellectual Property Office, GB, Search Report Under Section 17, GB1508916.2, dated Nov. 2, 2015, London, GB.
Intellectual Property Office, GB, Further Search Report Under Section 17, GB1508916.2, dated Aug. 17, 2016, London,GB.

* cited by examiner

*Primary Examiner* — Sean D Andrish
(74) *Attorney, Agent, or Firm* — Thomas B. McGurk

(57) ABSTRACT

A flood prevention device, for example an automatically closing air brick, is provided. The flood prevention device can comprise a body having an outer side and an inner side with an opening and a channel formed through the body, and a valve comprising a flap and a buoyancy structure, wherein the flap is pivotally mounted to the body and allows gas to flow through the channel in an open position and seals the channel in a closed position.

18 Claims, 3 Drawing Sheets

FLOOD PROTECTION DEVICE

This application is a national stage filing under 35 U.S.C. § 371 of International Application No. PCT/GB2016/051439 filed on May 19, 2016. This application claims priority of United Kingdom Patent Application No. 1508916.2 filed on May 26, 2015. Both of the above listed applications are incorporated by reference in their entirety herein.

FIELD OF INVENTION

The present invention relates to devices that allow gas to flow freely but prevent liquid flow in flood situations, for example vents and air bricks. In particular, the present invention provides an improved flood protection device. The device can be incorporated in an air brick or any other similar device.

BACKGROUND

There is a need in buildings that are susceptible to flooding for valves and vents that allow gas, such as air, to freely pass through in normal conditions but that prevent liquids, such as water, to pass through in flood conditions or in other similar conditions. For example, in buildings that are positioned in flood plains it is desirable to have air bricks to allow free ventilation of the building but it is also desirable that those air bricks do not allow water to enter the building in a flood situation. There have been several proposed solutions to this problem.

One proposed solution is to fit a flood-proof barrier to an outer side of an air brick when flood conditions are anticipated. For example, sand bags, periscopic attachments, or simple seals can be affixed to an air brick before flood conditions occur. However, such solutions are time and labour intensive and require prior knowledge of imminent flooding. Further, it is always necessary to physically remove such barriers after the flooding has abated. In light of these issues valves and vents that automatically prevent the ingress of fluids without the need for input from a user are preferred.

GB2397592 discloses a vent that comprises a float controlled valve having a float positioned within an air flow channel. The float may be a floating ball or cylinder. In a flood situation the float rises on the flood water to seal the air flow channel and prevent water ingress. The device of GB2397592 is relatively complex and expensive to manufacture. In particular, it is difficult to form and mount the float appropriately to provide a waterproof seal in the event of a flood. Therefore, there is a need for a less complex solution.

WO2010/060705 discloses a vent for an air brick comprising an air flow channel and a buoyant flap for sealing the channel in the event of a flood situation. In particular, the flap will normally rest in an open position wherein air can flow through the air flow channel. In a flood situation the flap will be buoyant on the water and rise from an open position to a closed position wherein the air flow channel is sealed. The flap is made buoyant by means of a float member provided on an outer side of the flap. Generally, the float member is provided at or near an upper edge of the flap.

The vent of WO2010/060705 is disadvantageous in that the flap will not be fully closed until the water level has reached the upper edge of the flap in the closed position. As a result, in situations where the water level is above the lower edge of the flap but below the upper edge of the flap in the closed position water may be allowed through the vent, for example by splashing over the top of the flap if the flood water is turbulent.

In light of the above, there is a need for an improved flood prevention device for vents or air bricks that has a simple construction and that will also prevent fluid ingress in all situations.

SUMMARY OF INVENTION

According to a first aspect, the present invention provides a flood prevention device for a vent or an air-brick comprising:

- a body having an outer side having at least one opening and an inner side having at least one opening;
- at least one channel formed through the body between the outer side and the at least one opening of the inner side; and
- a valve comprising a flap and a buoyancy structure, the flap being pivotally mounted to the body and having an outer side and an inner side, the flap having an open position in which gas is permitted to flow through the channel and a closed position in which the flap is pivoted from the open position to seal the channel;
- the buoyancy structure being formed on the outer side of the flap such that the valve is buoyant on water and if the outer side of the flap is exposed to a rising liquid level the centre of buoyancy of the valve is always located outwards of the flap and below an uppermost part of the flap and the buoyancy structure will act to move the flap from the open position to the closed position as the liquid level rises; wherein:
- the lowermost part of the at least one opening is formed at a height greater than a minimum height of liquid level at which the flap will be moved to the closed position.

The first aspect of the present invention is advantageous in that the at least one opening is formed such that a lowermost part thereof is formed at a height at which a liquid level cannot reach without the flap being moved from the open position to the closed position. That is, a rising water level will always act to move the flap from the open position to the closed position and thereby seal the device against water ingress before that liquid level reaches the lowermost part of the at least one opening. This prevents any chance of liquid passing through the device and removes the need for gaskets or other sealing means between the flap and the body when the flap is anything other than the closed position. For example, a device according to the first aspect of the present invention would not require a gasket or other sealing means between side walls of the flap and the body in order to prevent liquid passing around the side walls of the flap and through the at least one opening. Any liquid that would pass around the side walls of the flap would be at a level below the lowermost part of the at least one opening and would therefore not pass through the device.

It may be preferable that in a device according to the first aspect of the present invention the minimum height of liquid level at which the flap is moved to the closed position is less than 80% of a height from a lowermost part of the flap to the uppermost part of the flap when the flap is in the closed position. Even more preferably the minimum height of liquid level may be less than 70% of the height from the lowermost part of the flap to the uppermost part of the flap when the flap is in the closed position. Even more preferably, the minimum height may be less than 50% of the height from the lowermost part of the flap to the uppermost part of the flap when the flap is in the closed position.

A position that is outwards from the flap is any position that is positioned outwardly from a side of the flap that is outermost when the flap is in the closed position. The outer side of the flap is the side of the flap that would be exposed to liquid when the flap is in the closed position.

In order for buoyancy of the valve to move the flap from the open position to the closed position before the liquid level rises to the minimum height of liquid level it is necessary that the buoyancy structure is formed such that the buoyancy force from a rising liquid level is sufficiently strong and acts in an appropriate direction to rotate the flap before the liquid level rises to the minimum height. That is, as the liquid level rises and the valve is moved from the open position to the closed position, the centre of buoyancy of the valve must remain located outwards from the flap. When the valve is in the closed position and the liquid level rises above the minimum height of liquid level all that is required is that the liquid continues to act on the valve to keep it in the closed position. This can be achieved by a buoyancy force of the liquid on the valve and in certain embodiments of the invention can be achieved by the compression of a gas pocket providing a positive pressure to keep the valve in the closed position.

The buoyancy structure of the device according to the first aspect of the present invention may be any structure that can provide the flap with the appropriate buoyancy. For example, the buoyancy structure may comprise a component formed of a buoyant material, such as a foam or other lightweight material. Additionally or alternatively the buoyancy structure may comprises a gas chamber, for example an air chamber. The buoyancy structure may entirely consist of a component formed of a buoyant material or of a gas chamber. Alternatively, the buoyancy structure may additionally comprise one or more structural components to support the flap appropriately in the open and/or closed position and/or one or more structural components to appropriately position any buoyant component of the buoyancy structure relative to the flap. For example, in embodiments of the present invention the buoyancy structure may comprise one or more struts or a platform on which buoyant component is mounted in order that the buoyant component is held a distance away from the outer surface of the flap. Any such struts or platform may be formed to support the flap in the open position.

The buoyancy structure of a device according to the first aspect present invention may comprise an air chamber formed on the outer side of the flap. An air chamber may be a sealed chamber in which a volume of air or other gas is contained. The volume of gas in the sealed chamber will be sufficient to provide buoyancy to the valve.

According to a second aspect the present invention provides a flood prevention device for a vent or an air-brick comprising:

- a body having an outer side having at least one opening and an inner side having at least one opening;
- at least one channel formed through the body between the outer side and the at least one opening of the inner side; and
- a valve comprising a flap and a buoyancy structure, the flap being pivotally mounted to the body and having an outer side and an inner side, the flap having an open position in which gas is permitted to flow through the channel and a closed position in which the flap is pivoted from the open position to seal the channel;
- the buoyancy structure being formed on the outer side of the flap such that the valve is buoyant on water and if the outer side of the flap is exposed to a rising liquid level the centre of buoyancy of the valve is always located outwards of the flap and the buoyancy structure will act to move the flap from the open position to the closed position before the liquid level rises to the horizontal centre line of the flap; wherein
- the buoyancy structure comprises an air chamber formed on the outer side of the flap and having an open side, the open side of the air chamber being the lowermost side of the chamber when the flap is in the open position.

As an alternative to a sealed air chamber or other buoyancy means, as discussed above, the second aspect of the invention provides a buoyancy means that is an air chamber that is open at a lower side, the lower side being the lowermost side of the chamber when the flap is in the open position. If an air chamber is open at a lower side the chamber should be substantially airtight above said lower side such that air can only enter and leave the chamber via said lower side.

An air chamber that is open at a lower side will function in substantially the same manner as a sealed chamber or other buoyancy structure when the liquid level is relatively low i.e. when the liquid level rises from a lower edge of the flap to near the upper edge of the flap. In particular, the volume of gas within the buoyancy structure will be trapped by a rising liquid level providing buoyancy to the valve. An air chamber that is open at a lower side will be formed such that the volume of gas trapped therein by a rising liquid level makes the valve buoyant on liquid and the centre of buoyancy of the valve is always located outwards of the flap and below a horizontal centre line of the flap. As the liquid level rises the buoyancy of the volume of gas will act to rotate the valve from the open position to the closed position. If and when the liquid level recedes the valve will move back from the closed position to the open position under its own weight.

An air chamber that is open at a lower side may be particularly advantageous if, after the valve is in the closed position, the liquid level continues to rise. In this situation the volume of gas within the buoyancy structure will be compressed by the increased pressure of the liquid. As the volume of fluid is compressed this will decrease the buoyancy of the valve. However, the increased pressure of the volume of gas will exert a positive pressure on the flap thereby acting to retain it in the closed position in accordance with Boyle's Law. This action under Boyle's Law can act to provide a greater closing force on the valve compared to other buoyancy structures e.g. sealed air chambers or float members. In particular, the action under Boyle's Law can act to close the valve more quickly than previously possible and provide a greater force to close a valve than previously possible. In this manner the second aspect of the present invention is advantageous over prior art devices.

It will be readily understood that in a device according to the second aspect of the present invention liquid must not be able to pass through the channel of the device of the present invention when the valve is being moved from the open position to the closed position. In order to achieve this it may be preferable that either the device also includes the feature of the first aspect of the present invention or one or more sides of the valve are in sealing engagement with the body of the device as it moves from the open position to the closed position. For example, if the flap is mounted to rotate about a horizontal axis it may be preferable that sides of the flap between an upper edge and lower edge of the flap remain in sealing engagement with cooperatively positioned sides of the body of the device. As an example, this may be achieved by means of one or more gasket members mounted on the flap.

The first and second aspects of the present invention may be used in insolation from one another or in combination. That is a device according to the present invention may have only the feature of the first aspect of the present invention or only the feature of the second aspect of the present invention or a device according to the present invention may have the features of both the first and second aspects of the present invention. The following features are common to the first and second aspects of the present invention and may be present in any device according to the present invention.

As will be readily appreciated, after the flap has moved from the open position to the closed position it will only remain in that position as long as an liquid level acting on the buoyancy structure provides a sufficient buoyancy force to maintain the flap in that position. When the liquid level drops the flap will move back from the closed position to the open position under the action of its own weight absent sufficient buoyancy force to support it in the open position. In this manner, the device of the present invention will automatically open and close under a rising and lowering liquid level without the need for user input and without the risk of liquid passing through the device before it is completely closed.

As will be readily appreciated, in most situations the liquid will be water. However, devices according to the present invention may also operate under the action of other liquids.

The device of the present invention may preferably be an air vent that allows air to pass through in normal circumstances, when the flap is in the open position, but that prevents water passing through in flood conditions. For example, the device of the present invention may be incorporated in an air brick in the same manner as the devices discussed in the background above. However, as will be readily appreciated by the person skilled in the art, the device of the present invention is suitable for any application in which a valve is required that in normal conditions will allow gas to flow through freely but that must prevent liquid flow when the liquid level reaches a defined threshold. It is anticipated that the skilled person will be readily able to determine whether or not the device of the present invention is suitable for any specific application.

The flap of the present invention may have any suitable shape that allows it to be pivotally mounted and to freely move from the open position to the closed position. In order to allow the flap to form a completely watertight seal when the valve is in the closed position it may be preferable that the device comprises one or more gaskets formed on an inner side of the flap. The one or more gaskets being suitably positioned to form a completely watertight seal between the flap and the inner side of the body when the valve is in the closed position. Alternatively or additionally one or more gaskets may be formed on the body. Alternatively, the body and the valve may be formed such that when the valve is in the closed position a watertight seal is formed between the body and the valve without the need for a gasket.

The flap of the present invention may be formed of any suitable material. The flap must be sufficiently resilient to be able to seal the channel when in the closed position. Suitable materials will be apparent to the person skilled in the art and will be dependent upon the intended use of any specific embodiment of the present invention. In order to allow the flap to be moved easily from the open position to the closed position it may be preferable that the flap is made of a relatively lightweight buoyant material such as a polymer. In other embodiments it may be preferable that the flap is made of a particularly resilient, but potentially heavier, material, such as a metal. This may be preferred when it is anticipated that the flap will be subject to significant external forces. As will be readily appreciated, the material of the flap should be water resilient and should not corrode or otherwise degrade in the presence of water or any other fluid to which the flap is likely to be exposed.

If the buoyancy structure of a device according to the present invention is an air chamber (either sealed or open at a lower side) it may have substantially any shape that allows it to function appropriately. For example, an air chamber may be substantially cuboid. Alternatively, an air chamber may be a triangular prism with base faces formed perpendicular to the outer side of the flap and an outer side of the flap forming a longitudinal face of the prism. If the air chamber is formed as a triangular prism in this manner it may be preferable that the air chamber is open at a lower side, in accordance with the second aspect of the present invention, i.e. that the air chamber is open at a lowermost of the longitudinal faces of the triangular prism.

The flap of the present invention may be pivotally mounted to the body at substantially any point. As will be readily understood, it is preferable that the flap is pivotally mounted such that it rotates about a horizontal axis as this is the natural axis about which a body will rotate under an upwardly acting buoyancy force. However, it is appreciated that in some embodiments of the invention the axis about which the flap may rotate may be away from the horizontal.

It is preferable that the flap is pivotally mounted to the body at a lower half of the flap and even more preferable that the flap is pivotally mounted to the body at or near a lower edge of the flap. However, in alternative embodiments of the invention the flap may be pivotally mounted to the body above the centre line of the flap, for example at or near an upper edge of the flap. If the buoyancy structure of a device according to the present invention comprises an air chamber, either sealed or open at a lower side, it is preferable that the flap is pivotally mounted to the body at a position below a lower end of the air chamber.

The flap may be in substantially any orientation when in the closed position and when in the open position. It may be preferable that the flap is substantially vertical in the closed position or less than 45° from vertical, even more preferably substantially vertical or less than 20° from vertical. Most preferably the flap will be substantially vertical in the closed position. This may be preferred as if the liquid level rises above an upper edge of the flap the action of the liquid will act to keep the flap in the closed position more effectively if the flap is substantially vertical or removed from the vertical position by only a small distance.

The flap may be horizontal in the open position. However, it may be generally preferable that the open position is less than 45° from the closed position such that the rotational movement required to move the flap from the open position to the closed position is minimised. In particularly preferred embodiments of the invention the open position may be less than 20° from the closed position. As will be readily appreciated, if the flap is at or near vertical in the closed position and the open position is less than 45°, or less than 20°, from the closed position then the open position will be located substantially away from the horizontal position and towards the vertical position.

In embodiments of the present invention the buoyancy structure may be formed to support the flap in the open position. For example, when in the open position, the flap may rest upon the buoyancy structure which, in turn, may rest upon a supporting structure. Alternatively, when in the open position, the flap may rest directly upon a supporting structure and be maintained in position thereby. As a further alternative, the flap may be prevented from opening further than the open position using any appropriate retaining means such as a tie or cable. Any suitable method of supporting the flap in the open position may be utilised either in isolation or in combination provided that in normal use the flap can be maintained in the open position and gas is allowed to pass through the channel and that when the flap is exposed to a rising liquid level the flap can move freely from the open position towards the closed position.

As set out above, it may be preferable that the device of the present invention forms the valve of an air brick. In particular, the body of the invention may be the air brick and the channel may be an air passage formed through the brick. In such an air brick air would normally be allowed to flow through the brick as the flap would be positioned in the open position. When flood waters rise the rising water would move the flap from the open position to the closed position, thereby sealing the air brick and preventing flood water from entering a building in which the air brick is located. Importantly, the flap would be in the closed position and the air brick would be completely sealed before the flood water rises to the horizontal centre line of the flap.

Further features and advantages of the present invention will be apparent from the specific embodiment that is illustrated in the Figures and that is described below.

DRAWINGS

Figure 1:
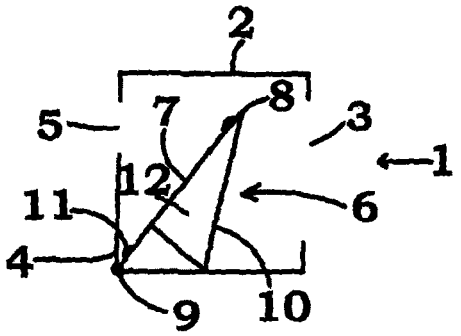
FIG. 1 is a schematic side view of a first embodiment of the present invention with the valve in the open position.

A first embodiment of an air brick 1 according to the first and second aspects of the present invention is illustrated schematically in FIGS. 1 to 4. The air brick 1 comprises a body 2 having an outer side 3 and an inner side 4. For clarity, the body 2 is shown as being transparent in FIGS. 3 and 4, although generally it will not be formed of a transparent material. The body 2 is formed of a plastic material. The outer side 3 is open and the inner side 4 has an opening 5 formed therethrough. A valve 6 is pivotally mounted within the body 2. The valve 6 comprises a planar rectangular flap 7 having an upper edge 8 and a lower edge 9 and a buoyancy structure 10 attached to an outer side of the flap 7. The flap 7 is pivotally mounted to the body 2 at its lower edge 9 such that the lower edge is positioned adjacent the inner side 4 of the body 2. The flap 7 is formed of a resilient and water-resistant polymeric material. The buoyancy structure 10 is mounted on an outer side of the flap 7. The buoyancy structure 10 is an air chamber that is a triangular prism and is open at a lower side. Other than the opening at the lower side the buoyancy structure 10 is airtight. The buoyancy structure 10 and the flap 7 are both formed of a plastic material. The flap 7 has a rubber gasket 11 mounted on an inner side.

Figure 2:
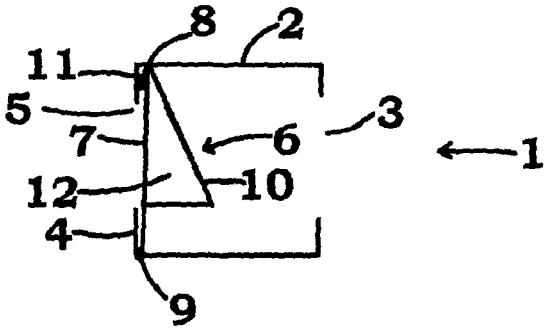
FIG. 2 is a schematic side view of the first embodiment of the present invention with the valve in the closed position.
Figure 3:
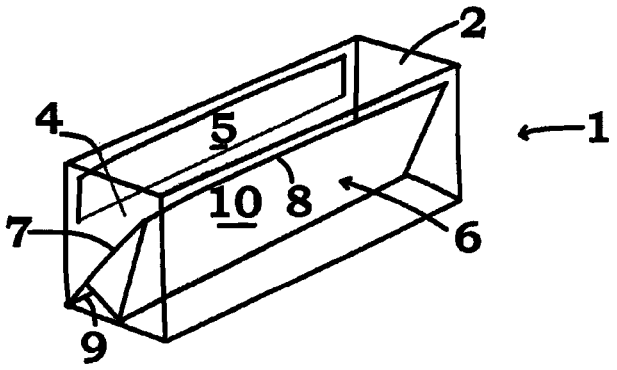
FIG. 3 is a schematic isometric view of the first embodiment of the present invention with the valve in the open position.
Figure 4:
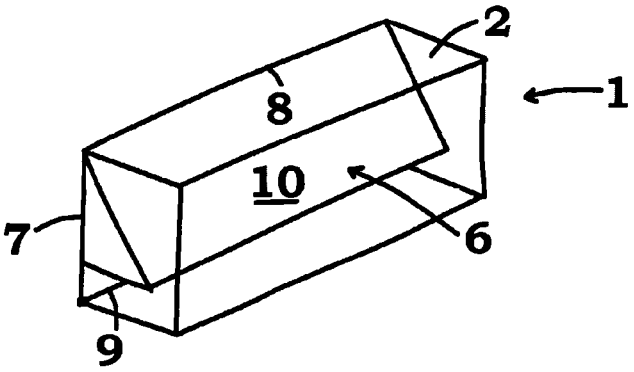
FIG. 4 is a schematic isometric view of the first embodiment of the present invention with the valve in the closed position.

The flap 7 can be pivoted about its lower edge 9 between an open position and a closed position. The open position is shown in FIGS. 1 and 3 and is approximately 20° from the closed position, which is shown in FIGS. 2 and 4. In the open position the flap 7 is supported by the buoyancy structure 10 resting on a lower portion of the body 2. In the closed position the flap 7 is substantially vertical and seals the opening 5 of the body 2 by means of the gasket 11 pressing against the body 2 around the opening 5. The opening 5 is formed such that a lowermost part of the opening 5 is at a height greater than a minimum height of liquid level at which the flap 7 will be moved to the closed position.

In FIGS. 1 and 3 the flap 7 is shown in the open position. In this position air is free to flow through the air brick 1. In particular, air can pass over the upper edge 8 of the flap 7, through the opening 5, and through the air brick 1. In FIGS. 2 and 4 the flap 7 is shown in the closed position. In this position the air brick 1 is sealed as the flap 7 is positioned directly in front of the opening 5 of the inner side 4 and the gasket 11 is acting to seal the flap 7 against the inner side 4 of the body 2 around the opening 5.

The air brick 1 operates in the following manner. In normal conditions the flap 7 is in the open position as shown in FIGS. 1 and 3. Air is free to pass through the air brick 1 and the building in which the air brick is located is ventilated. In all non-flood conditions the air brick 1 will remain in this position.

In a flood situation external water levels will rise. When the external water level reaches the bottom of the air brick 1 it will enter the body 2 from the outer side 3. The water will not be able to pass through the air brick 1 as the water level will be below the height of the opening 5.

As the water level rises it will enter under the buoyancy structure 10. A volume of air 12 is contained within the buoyancy structure 10. As the buoyancy structure 10 is only open at a lower side and is otherwise airtight the volume of air 12 within the buoyancy structure will be trapped by a rising water level providing buoyancy to the flap. The buoyancy structure 10 is formed such that the volume of air 12 trapped therein by a rising water level makes the flap 7 buoyant on water and the centre of buoyancy of the valve 6 is always located outwards of the flap 7 and below a the lowermost part of the opening 5. Therefore, as the water level rises the buoyancy of the volume of air 12 acts to rotate the flap 7 from the open position to the closed position, thereby sealing the air brick 1. Importantly, the air brick will be completely sealed against fluid (liquid and gas) ingress long before the water level rises to the top edge of the flap 7 and before the water level reaches the height of the opening 5. Therefore, at no point can water pass through the opening 5. When the water level recedes the flap 7 will move back from the closed position to the open position under its own weight and the air brick 1 will allow air flow again.

Having the flap 7 of the valve 6 in the closed position and sealing the air brick 1 long before a rising water level reaches the top edge of the flap 7 and before the water level reaches the height of the opening 5 is advantageous as it ensures that no water will pass through the air brick 1. This is particularly advantageous if the rising water is turbulent and not calm as in turbulent conditions if the flap 7 is not in the closed position when the water level is at or near the top edge of the flap 7 water may splash over the top of the flap and through the air brick 1.

If, after the flap 7 is in the closed position, the water level continues to rise the volume of air 12 within the buoyancy structure will be compressed by the increased pressure of the water. As the volume of air 12 is compressed this will decrease the buoyancy of the valve 6. However, the increased pressure of the volume of air 12 will exert a positive pressure on the flap 7 thereby acting to retain it in the closed position in accordance with Boyle's Law.

Figure 5:
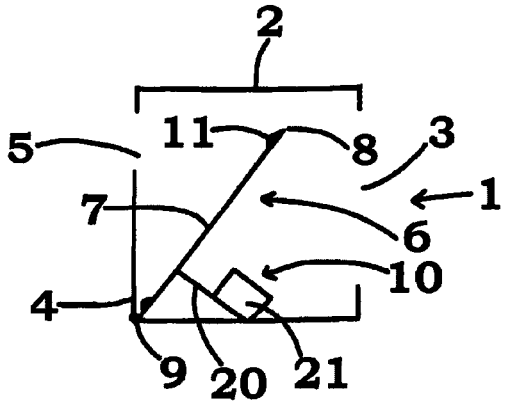
FIG. 5 is a schematic side view of a second embodiment of the present invention with the valve in the open position.
Figure 6:
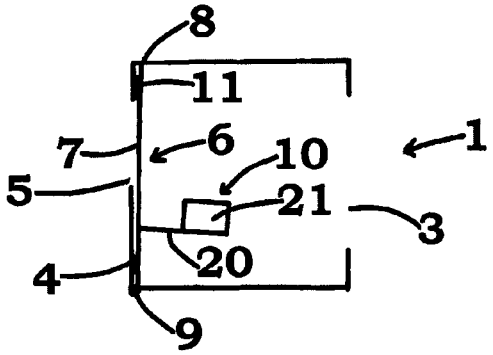
FIG. 6 is a schematic side view of a second embodiment of the present invention with the valve in the closed position.

A schematic of an alternative embodiment of an air brick 1 according to the first (but not the second) aspect of the present invention is shown in FIGS. 5 and 6. The structure of the alternative embodiment of the invention is substantially the same as the embodiment of FIGS. 1 to 4 with the exception of the structure of the buoyancy structure 10 and operates in substantially the same manner. Therefore, the same reference numerals have been used to indicate the equivalent structures of the alternative embodiment.

The alternative embodiment differs in the structure of the buoyancy structure 10. The buoyancy structure 10 comprises a support arm 20 with a float member 21 mounted on an outer end of the support arm. The support arm 20 extends outwards from an outer side of the flap 7 in a direction normal to the flap 7. The support arm 20 supports the flap 7 in the open position, as shown in FIG. 5. In particular, the valve 6 rests against a lower portion of the body 2 by means of the support arm 20. The support arm 20 extends from a part of the flap 7 below a horizontal centre line of the flap 7.

The float member 21 mounted on an outer end of the support arm 20 is formed of a material that is buoyant on water and is formed and positioned such that a rising water level makes the flap 7 buoyant on water, the centre of buoyancy of the valve 6 always being located outwards of the flap 7 and below a horizontal centre line of the flap 7. Therefore, as the water level rises the buoyancy of the float member 21 acts to rotate the flap 7 from the open position to the closed position, thereby sealing the air brick 1. Importantly, the air brick 1 will be completely sealed against fluid ingress long before the water level rises to the top edge of the flap 7 and before the water level reaches the height of the opening 5. When the water level recedes the flap 7 will move back from the closed position to the open position under its own weight and the air brick 1 will allow air flow again.

The invention claimed is:

1. A flood protection device for a vent or an air-brick comprising:

a body having an outer side having at least one opening and an inner side having at least one opening;

at least one channel formed through the body between the outer side and the at least one opening of the inner side;

a valve comprising a flap and a buoyancy structure, the flap being pivotally mounted to the body and having an outer side and an inner side, the flap having an open position in which gas is permitted to flow through the at least one channel and a closed position in which the flap is pivoted from the open position to seal the at least one channel;

the buoyancy structure being formed on the outer side of the flap such that the valve is buoyant on water, wherein a centre of buoyancy of the valve is always located outwards of the flap and the buoyancy structure will act to move the flap from the open position to the closed position as a rising liquid level rises on the outer side of the flap to a horizontal centre line of the flap; and, wherein the buoyancy structure comprises an air chamber formed on the outer side of the flap and having an open side, the open side of the air chamber being a lowermost side of the air chamber when the flap is in the open position.

2. A device according to claim 1, wherein the air chamber is substantially cuboid.

3. A device according to claim 1 wherein the air chamber is a triangular prism with a base face formed perpendicular to the outer side of the flap and the outer side of the flap forming a longitudinal face of the triangular prism.

4. A device according to claim 3, wherein the air chamber is open at a lowermost of longitudinal faces of the triangular prism.

5. A flood protection device for a vent or an air-brick comprising:

a body having an outer side having at least one opening and an inner side having at least one opening of the inner side;

at least one channel formed through the body between the outer side and the at least one opening of the inner side;

a valve comprising a flap and a buoyancy structure, the flap being pivotally mounted to the body and having an outer side and an inner side, the flap having an open position in which gas is permitted to flow through the at least one channel and a closed position in which the flap is pivoted from the open position to seal the at least one channel;

the buoyancy structure being formed on the outer side of the flap such that the valve is buoyant on water, wherein a centre of buoyancy of the valve is always located outwards of the flap and below an uppermost part of the flap and the buoyancy structure will act to move the flap from the open position to the closed position as a rising liquid level rises on the outer side of the flap; and, wherein a lowermost part of the at least one opening of the inner side is formed at a height greater than a minimum height of liquid level at which the flap will be moved to the closed position.

6. A device according to claim 5, wherein the buoyancy structure comprises a sealed air chamber formed on the outer side of the flap.

7. A device according to claim 6, wherein the sealed air chamber is substantially cuboid.

8. A device according to claim 6 wherein the sealed air chamber is a triangular prism with base faces formed perpendicular to the outer side of the flap and the outer side of the flap forming a longitudinal face of the prism.

9. A device according to claim 6, wherein the flap is pivotally mounted to the body at a position below a lower end of the sealed air chamber.

10. A device according to claim 5, wherein the buoyancy structure comprises a float formed of buoyant material mounted to the outer side of the flap.

11. A device according to claim 5, wherein the flap is substantially planar.

12. A device according to claim 5, further comprising a gasket formed on the inner side of the flap.

13. A device according to claim 5, wherein the flap is pivotally mounted to the body at a lower edge of the flap.

14. A device according to claim 5, wherein the flap is substantially vertical in the closed position.

15. A device according to claim 5, wherein the buoyancy structure is formed to support the flap in the open position.

16. A device according to claim 5, wherein the flap is in the open position the buoyancy structure rests upon a supporting structure.

17. A device according to claim 5, wherein the open position is less than 20° from the closed position.

18. An air brick comprising the flood protection device according to claim 5.

* * * * *